US010998155B2

(12) United States Patent
Lee et al.

(10) Patent No.: US 10,998,155 B2
(45) Date of Patent: May 4, 2021

(54) CONTACTOR WITH ARC SUPPRESSOR

(71) Applicant: TE CONNECTIVITY CORPORATION, Berwyn, PA (US)

(72) Inventors: Albert Yong Lee, Greensboro, NC (US); Roger Lee Thrush, Clemmons, NC (US)

(73) Assignee: TE Connectivity Corporation, Berwyn, PA (US)

( * ) Notice: Subject to any disclaimer, the term of this patent is extended or adjusted under 35 U.S.C. 154(b) by 282 days.

(21) Appl. No.: 16/263,679

(22) Filed: Jan. 31, 2019

(65) Prior Publication Data

US 2020/0234902 A1 Jul. 23, 2020

Related U.S. Application Data

(60) Provisional application No. 62/793,925, filed on Jan. 18, 2019.

(51) Int. Cl.
*H01H 50/38* (2006.01)

(52) U.S. Cl.
CPC ..... *H01H 50/38* (2013.01); *H01H 2205/002* (2013.01)

(58) Field of Classification Search
CPC ..... H01H 50/38; H01H 2205/002; H01H 50/546; H01H 9/443
See application file for complete search history.

(56) References Cited

U.S. PATENT DOCUMENTS 5,546,061 A * 8/1996 Okabayashi ..... H01H 9/443 335/126
8,653,691 B2 * 2/2014 Hsu ..... H01H 9/443 307/10.1
10,727,008 B2 * 7/2020 Hoffmann ..... H01H 50/546
2011/0120844 A1 * 5/2011 Hoffmann ..... H01H 50/02 200/275
2012/0175345 A1 7/2012 Tachikawa et al.
2014/0176268 A1 * 6/2014 Suzuki ..... H01H 9/443 335/201

FOREIGN PATENT DOCUMENTS

EP 2557582 A1 2/2013

OTHER PUBLICATIONS

International Search Report, International Application No. PCTIB2020/050237 International Filing Date, Jan. 13, 2020.

* cited by examiner

*Primary Examiner* — Mohamad A Musleh

(57) ABSTRACT

A contactor includes a housing having an outer wall defining a cavity, fixed contacts and a movable contact within the cavity, and a coil assembly in the cavity operated to move the movable contact between an unmated position and a mating position with the fixed contacts. The contactor includes an arc suppressor in the cavity including a first magnet located in the cavity on a first side of the movable contact and a second magnet located in the cavity on a second side of the movable contact. The first magnet is arranged in the cavity such that a north B-field of the first magnet faces outward toward the outer wall of the housing. The second magnet is arranged in the cavity such that a north B-field of the second magnet faces outward toward the outer wall of the housing.

20 Claims, 6 Drawing Sheets

CONTACTOR WITH ARC SUPPRESSOR

CROSS-REFERENCE TO RELATED APPLICATIONS

This application claims benefit to U.S. Provisional Application No. 62/793,925, which was filed Jan. 18, 2019 and is titled Arc Blow-Out Magnets with North B-Field Facing Outward for Improved Contactor Performance. The subject matter of which is herein incorporated by reference in its entirety.

BACKGROUND OF THE INVENTION

The subject matter herein relates generally to high power electrical contactors.

Certain electrical applications, such as HVAC, power supply, locomotives, elevator control, motor control, aerospace applications, hybrid electric vehicles, fuel-cell vehicles, charging systems, and the like, utilize electrical contactors having contacts that are normally open (or separated). The contacts are closed (or joined) to supply power to a particular device. When the contactor receives an electrical signal, the contactor is energized to introduce a magnetic field to drive a movable contact to mate with fixed contacts. During mating and unmating of the movable contact with the fixed contacts, electrical arcing may occur, which may cause damage to the contacts, such as oxidation of the surfaces of the contacts, leading to failure of the contactor over time.

Some known contactors include arc suppressors to suppress the effects of electrical arcing to protect the contacts. For example, magnets may be located in the vicinity of the contacts to create electrical fields around the contacts, which extinguishes the electrical arcing. Conventional contactors require that the magnets be loaded in a particular orientation as the contactors are sensitive to the polarity of the magnets relative to the contacts. Assembly of the contactor is difficult. For example, loading of the magnets into the contactor may be time consuming and labor intensive. Additionally, the magnets may be improperly loaded or loaded in an improper orientation, such as being loaded in an incorrect polarity direction relative to other magnets, leading to malfunctioning or rework. For example, the arc debris extinguished during arc suppression is blown toward the center of the contactor if the magnets are loaded in an improper orientation. The arc debris may be deposited on the contacts, which can lead to damage to the contacts due to erosion or rupture over time.

Moreover, conventional arrangements of the magnets in the contactor compound with Lorentz and Holm's forces, which repulse the movable contact away from the fixed contacts leading to a short circuit condition. For example, during high current conditions, the magnetic forces may overcome holding forces between the movable contact and the fixed contacts causing the contactor to open.

A need exists for a contactor that overcomes the above problems and addresses other concerns experienced in the prior art.

BRIEF DESCRIPTION OF THE INVENTION

In one embodiment, a contactor is provided including a housing having an outer wall defining a cavity, fixed contacts received in the cavity having mating ends in the cavity, a movable contact movable within the cavity between a mated position and an unmated position engaging the fixed contacts to electrically connect the fixed contacts in the mated position, and a coil assembly in the cavity operated to move the movable contact between the unmated position and the mating position. The contactor includes an arc suppressor in the cavity. The arc suppressor includes a first magnet located in the cavity on a first side of the movable contact and a second magnet located in the cavity on a second side of the movable contact. The first magnet is arranged in the cavity such that a north B-field of the first magnet faces outward toward the outer wall of the housing. The second magnet is arranged in the cavity such that a north B-field of the second magnet faces outward toward the outer wall of the housing.

In another embodiment, a contactor is provided including a housing having an outer wall defining a cavity, a first fixed contact received in the cavity at a first end of the housing and a second fixed contact received in the cavity at a second end of the housing. The contactor includes a movable contact movable within the cavity between a mated position and an unmated position. The movable contact engages the first and second fixed contacts to electrically connect the first and second fixed contacts in the mated position. The contactor includes a coil assembly in the cavity operated to move the movable contact between the unmated position and the mating position. The contactor includes an arc suppressor in the cavity. The arc suppressor includes a first magnet located in the cavity on a first side of the first fixed contact, a second magnet located in the cavity on a second side of the first fixed contact, a third magnet located in the cavity on a first side of the second fixed contact, and a fourth magnet located in the cavity on a second side of the second fixed contact. The first magnet is arranged in the cavity such that a north B-field of the first magnet faces outward toward the outer wall of the housing. The second magnet is arranged in the cavity such that a north B-field of the second magnet faces outward toward the outer wall of the housing. The third magnet is arranged in the cavity such that a north B-field of the third magnet faces outward toward the outer wall of the housing. The fourth magnet is arranged in the cavity such that a north B-field of the fourth magnet faces outward toward the outer wall of the housing.

In a further embodiment, a contactor is provided including a housing having an outer wall defining a cavity, fixed contacts received in the cavity having mating ends in the cavity, a movable contact movable within the cavity between a mated position and an unmated position engaging the fixed contacts to electrically connect the fixed contacts in the mated position, and a coil assembly in the cavity operated to move the movable contact between the unmated position and the mating position. The contactor includes an arc suppressor in the cavity including a first magnet located in the cavity on a first side of the movable contact and a second magnet located in the cavity on a second side of the movable contact. The first magnet includes a north pole and a south pole and the second magnet includes a north pole and a south pole. The first magnet is arranged in the cavity such that the north pole of the first magnet faces outward toward the outer wall of the housing and the south pole of the first magnet faces the movable contact. The second magnet is arranged in the cavity such that the north pole of the second magnet faces outward toward the outer wall of the housing and the south pole of the first magnet faces the movable contact.

DETAILED DESCRIPTION OF THE INVENTION

Figure 1:
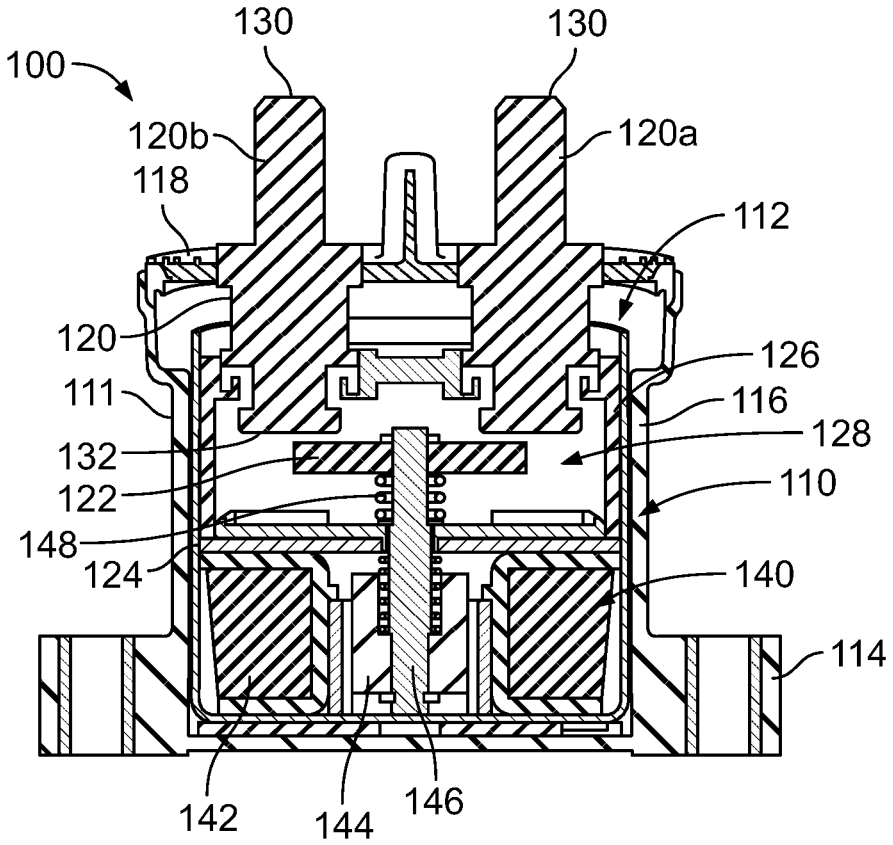
FIG. 1 is a cross-sectional view of a contactor including an arc suppressor in accordance with an exemplary embodiment.

FIG. 1 is a cross-sectional view of a contactor 100 in accordance with an exemplary embodiment. The contactor 100 is an electrical switch or relay that safely connects and disconnects one or more electrical circuits to protect the flow of power through the system. The contactor 100 may be used in various applications such as HVAC, power supply, locomotives, elevator control, motor control, aerospace applications, hybrid electric vehicles, fuel-cell vehicles, charging systems, and the like.

The contactor 100 includes a housing 110 having an outer wall 111 surrounding a cavity 112. The housing 110 may be a multi-piece housing in various embodiments. The housing 110 includes a base 114 and a header 116 extending from the base 114. Optionally, the base 114 may be configured to be coupled to another component. For example, the base 114 may include mounting brackets for securing the contactor 100 to the other component. In the illustrated embodiment, the header 116 is located above the base 114; however, the housing 110 may have other orientations in alternative embodiments. The housing 110 includes a cover 118 for closing the cavity 112. For example, the cover 118 may be coupled to the top of the header 116. Optionally, the cover 118 may be sealed to the header 116. The outer wall 111 along the header 116 may be cylindrical defining a cylindrical cavity 112 in various embodiments.

The contactor 100 includes fixed contacts 120 received in the cavity 112 and a movable contact 122 movable within the cavity 112 between a mated position and an unmated position. The movable contact 122 engages the fixed contacts 120 to electrically connect the fixed contacts 120 in the mated position. In the illustrated embodiment, the contactor 100 includes first and second fixed contacts 120*a*, 120*b*. The fixed contacts 120 are fixed to the housing 110. For example, the fixed contacts 120 may be coupled to the header 116 and/or the cover 118. In other various embodiments, the fixed contacts 120 may be coupled to an insert 124 of the housing 110 inserted into the cavity 112. The insert 124 may be removable from the cavity 112 when the cover 118 is removed from the header 116. In an exemplary embodiment, the insert 124 of the housing 110 includes a contact holder 126 configured to hold the fixed contacts 120. The contact holder 126 defines an enclosure 128. The fixed contacts 120 extend into the enclosure 128. The movable contact 122 is located in the enclosure 128.

The fixed contacts 120 each include a terminating end 130 and a mating end 132. The terminating end 130 is configured to be terminated to another component, such as a wire or a terminal, such as a line in or a line out wire. In an exemplary embodiment, the terminating end 130 is exposed at the exterior of the contactor 100 for terminating to the other component. The terminating end 130 may be threaded to receive a nut. In the illustrated embodiment, the terminating end 130 extends through the cover 118 and is located above the cover 118. The mating end 132 is located within the cavity 112 for mating engagement with the movable contact 122, such as when the contactor 100 is energized. In the illustrated embodiment, the mating end 132 is generally flat for engaging the movable contact 122. However, the mating end 132 may have other shapes in alternative embodiments, such as a rounded shape to form a mating bump at the mating end 132 for mating with the movable contact 122.

The contactor 100 includes a coil assembly 140 in the cavity 112 operated to move the movable contact 122 between the unmated position and the mated position. The coil assembly 140 includes a winding or coil 142 wound around a core 144 to form an electromagnet. The coil assembly 140 includes a plunger 146 coupled to the core 144. The movable contact 122 is coupled to the plunger 146 and is movable with the plunger 146 when the coil assembly 140 is operated. The coil assembly 140 includes a spring 148 for returning the movable contact 122 to the unmated position when the coil assembly 140 is deenergized.

In an exemplary embodiment, the contactor 100 includes an arc suppressor 160 for suppressing electrical arc of the electrical circuit. The arc suppressor 160 is located in the cavity 112 of the housing 110. Optionally, the arc suppressor 160 may be located in the contact holder 126, such as in or near the enclosure 128. In an exemplary embodiment, the arc suppressor 160 includes magnets creating magnetic fields in the enclosure 128 for suppressing arc created between the movable contact 122 and the fixed contacts 120. In an exemplary embodiment, the contact holder 126 of the insert 124 may be sealed and may be filled with an inert gas for arc suppression.

Figure 2:
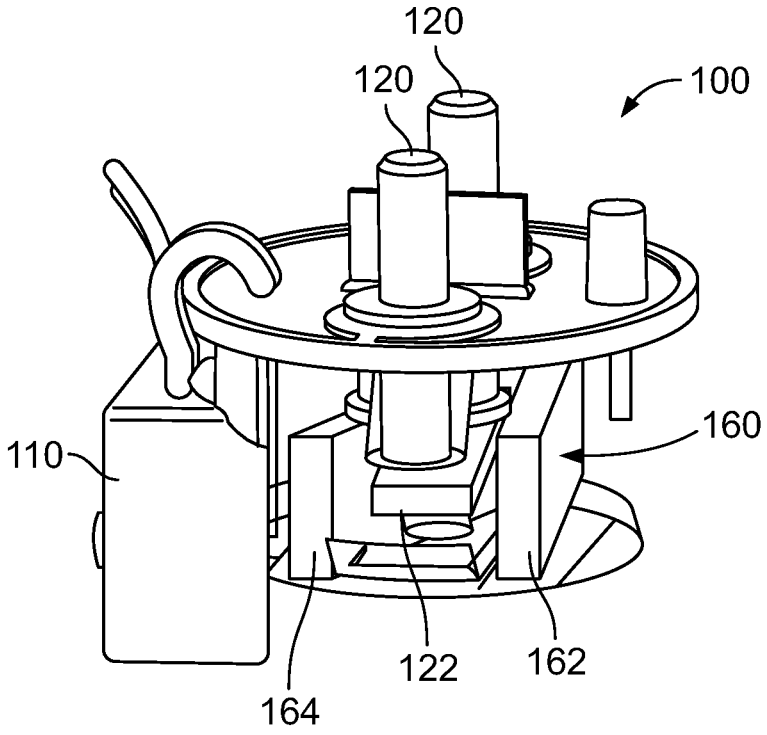
FIG. 2 is a perspective view of a portion of the contactor in accordance with an exemplary embodiment.

FIG. 2 is a perspective view of a portion of the contactor 100 with portions of the housing 110 removed to illustrate the fixed contacts 120 and the movable contact 122 (for example, the outer wall 111 is not shown to illustrate the contacts 120, 122 within the cavity 112). FIG. 2 illustrates the arc suppressor 160 in accordance with an exemplary embodiment. In the illustrated embodiment, the arc suppressor 160 includes a first magnet assembly 162 located on a first side of the movable contact 122 and the fixed contacts 120 and a second magnet assembly 164 located on a second side of the movable contact 122 and the fixed contacts 120. In various embodiments, the arc suppressor 160 may include a single magnet assembly, such as the first magnet assembly 162 rather than the pair of magnet assemblies 162, 164. In other various embodiments, more than two magnet assemblies may be provided. The magnet assemblies 162, 164 are located in the vicinity of the fixed contacts 120 and the movable contact 122 for suppressing electrical arcs between the fixed contacts 120 and the movable contact 122 during making or breaking of the electrical circuit. In an exemplary embodiment, the magnet assemblies are arranged such that north B-fields of magnets of the magnet assemblies face outward, away from the movable contact 122 and the fixed contacts 120. As such, the magnets force the arc debris outward away from the movable contact 122 and the fixed contacts 120 quickly and efficiently.

Figure 3:
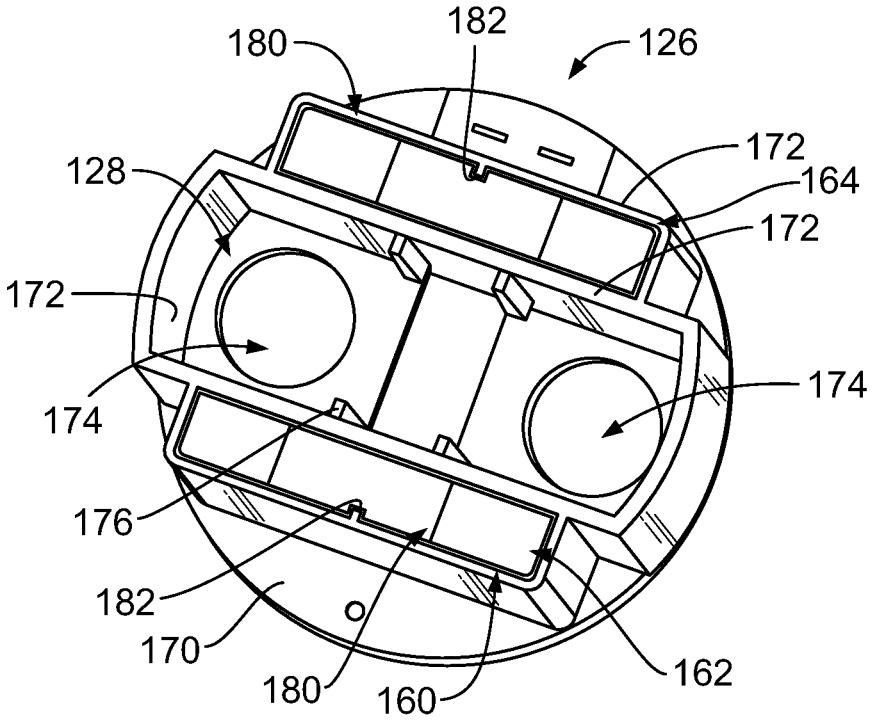
FIG. 3 is a bottom perspective view of a contact holder of the contactor in accordance with an exemplary embodiment.

FIG. 3 is a bottom perspective view of the contact holder 126 in accordance with an exemplary embodiment. The contact holder 126 of the housing 110 includes a base wall 170 and enclosure walls 172 extending from the base wall 170. The enclosure walls 172 define the enclosure 128 that receives the movable contact 122. Optionally, the base wall 170 may be located above the enclosure 128 with the enclosure walls 172 extending below the base wall 170. The base wall 170 includes contact openings 174 receiving the fixed contacts 120 (shown in FIG. 1). Optionally, the contact holder 126 may include guide walls 176 extending from the enclosure walls 172 to engage and guide the movable contact 122 within the enclosure 128.

In an exemplary embodiment, the enclosure walls 172 define magnet slots 180 that receive corresponding magnet assemblies 162, 164 of the arc suppressor 160. The magnet slots 180 are sized and shaped to receive the magnet assemblies 162, 164. In the illustrated embodiment, the magnet slots 180 are rectangular shaped; however, the magnet slots 180 may have other shapes in alternative embodiments. In an exemplary embodiment, the contact holder 126 includes keying features 182 extending into the magnet slots 180. The keying features 182 may be used to orient the magnet assemblies 162, 164 within the magnet slots 180.

Figure 4:
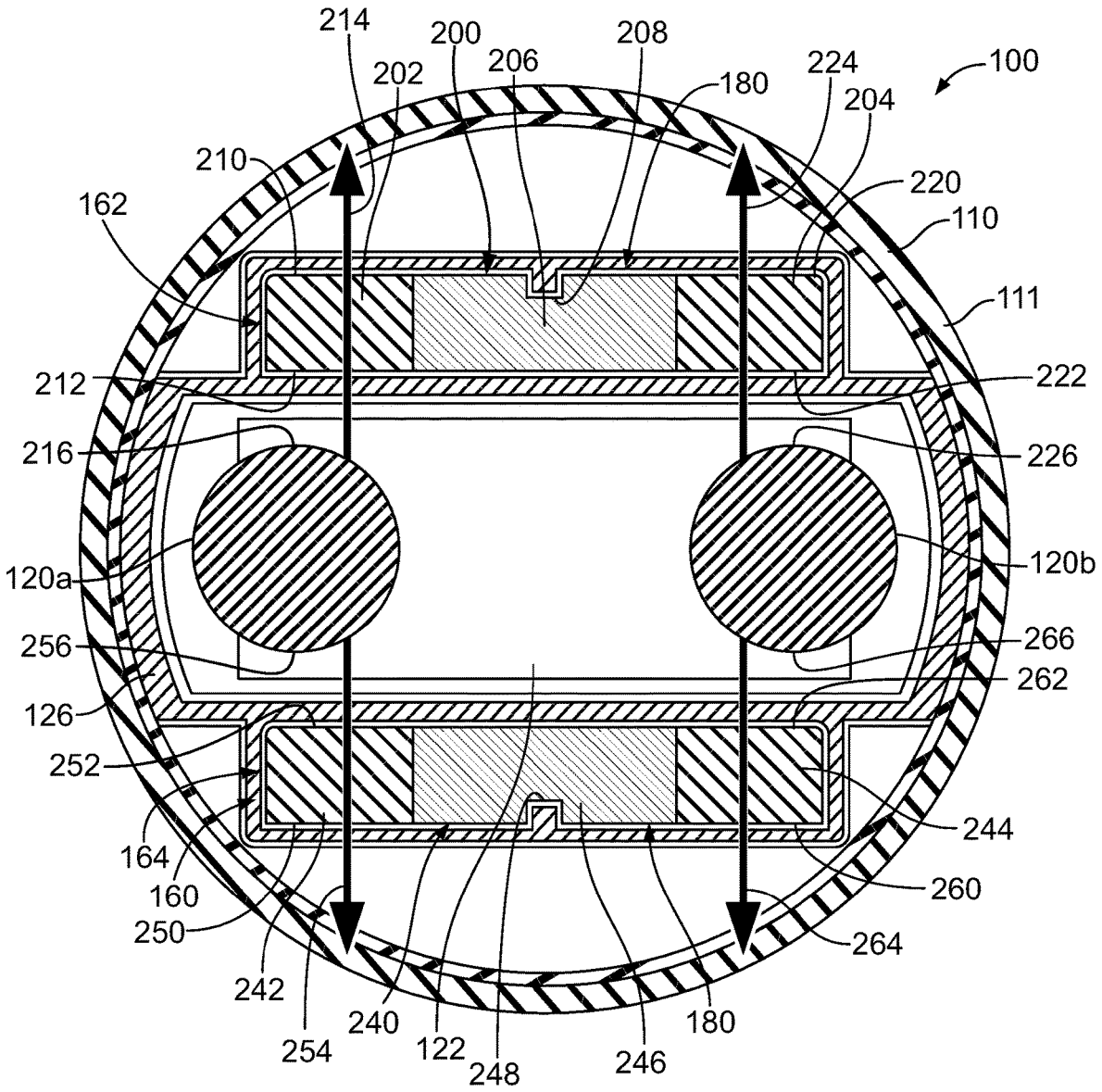
FIG. 4 is a cross sectional view of the contactor including the arc suppressor in accordance with an exemplary embodiment.

FIG. 4 is a cross sectional view of the contactor 100 including the arc suppressor 160 in accordance with an exemplary embodiment. FIG. 4 shows the magnet assemblies 162, 164 in the magnet slots 180 of the contact holder 126. FIG. 4 shows the fixed contacts 120 and the movable contact 122 below the fixed contacts 120.

The magnet assembly 162 includes a plurality of magnets integrated into a unitary magnet body 200. The unitary magnet body 200 includes the various magnets being held together as a single unit. The unitary magnet body 200 defines a monolithic structure wherein the magnets are coupled together as part of the unitary magnet body 200. Physical manipulation of any one of the magnets causes corresponding physical manipulation of the other magnet(s) of the magnet assembly 162. For example, transferring of the magnet assembly 162 into the magnet slot 180 or removing of the magnet assembly 162 from the magnet slot 180 allows transfer of all of the magnets of the magnet assembly 162 as a unitary structure. Individual magnets do not need to be physically transferred relative to each other.

In the illustrated embodiment, the magnet assembly 162 includes a first magnet 202, a second magnet 204, and a non-magnetic body 206 arranged in the gap between the first and second magnets 202, 204. The non-magnetic body 206 is located between the first and second magnets 202, 204 and separates the first and second magnets 202, 204. The non-magnetic body 206 holds the positions of the first and second magnets 202, 204 relative to each other. The gap removes or reduces the magnetic field in an area of the magnet assembly 162 to reduce repulsive forces acting on the movable contact 122 that repulses the movable contact 122 away from the fixed contacts 120. The magnet assembly improves short circuit conditions, such as during high current conditions, by reducing the repulsive forces by reducing the magnetic fields of the magnet assembly 162, such as in areas offset from the areas generating the arc (for example, in the area offset from the fixed contacts 120). The gap may be located in the area between the fixed contacts 120.

In an exemplary embodiment, the magnets 202, 204 and the non-magnetic body 206 are extruded with each other to form the unitary magnet body 200. For example, the magnets 202, 204 may be neodymium magnets and the non-magnetic body 206 may be an aluminum block or other non-magnetic material block. The neodymium magnets may be co-extruded with the aluminum block to form the unitary magnet body 200. In other various embodiments, the magnets 202, 204 and the aluminum block may be separately manufactured and secured together, such as using adhesive, glue, welding, or other means. In other various embodiments, the magnets 202, 204 and the non-magnetic body 206 may be overmolded or wrapped, such as by a plastic outer body to form the unitary magnet body 200.

In an exemplary embodiment, the unitary magnet body 200 includes one or more keying features 208. In the illustrated embodiment, the keying feature 208 is a groove formed in the side of the non-magnetic body 206. Optionally, the keying feature 208 may be centered within the unitary magnet body 200. In other various embodiments, the keying feature 208 may be offset rather than being centered. In various embodiments, keying features 208 may be provided at multiple sides of the unitary magnet body 200. The keying features 208 may be located at other locations in alternative embodiments. In other various embodiments, the magnets 202, 204 may additionally or alternatively include the keying features 208. In other various embodiments, rather than being a groove, the keying feature 208 may be a rib or protrusion extending outward from one or more surfaces of the unitary magnet body 200. The keying feature 208 may be defined by other walls or surfaces of the unitary magnet body 200 in other various embodiments. For example, the top and/or the bottom and/or the sides may be angled or chamfered to define keying features.

In an exemplary embodiment, each of the magnets 202, 204 are arranged relative to the contacts 120, 122 such that the north B-fields of the magnets 202, 204 face outward, away from the contacts 120, 122. As such, the magnets 202, 204 force the arc debris outward away from the contacts 120, 122 quickly and efficiently.

The first magnet 202 includes a north pole 210 and a south pole 212 opposite the north pole 210. The north pole 210 is defined by a side surface of the first magnet 202. The south pole 212 is defined by a side surface of the first magnet 202. The surface area of the side surfaces of the magnet 202 contribute to the arc suppression and controlling height, length, width of the side surface may affect arc suppression of the first magnet 202. Proximity of the first magnet 202 relative to the contacts 120, 122 may affect arc suppression. The first magnet 202 has a north B-field 214 (extending outward from the north pole 210). The first magnet 202 is oriented in the magnet slot 180 with the south pole 212 facing inward and the north pole 210 facing outward. The south pole 212 faces the contacts 120, 122. The north pole 210 faces the outer wall 111 of the housing 110. The north B-field 214 of the first magnet 202 faces outward toward the outer wall 111 of the housing 110, away from the contacts 120, 122. In an exemplary embodiment, the first magnet 202 is aligned with the first fixed contact 120*a*. The first magnet 202 is arranged at a first side 216 of the first fixed contact 120*a*.

The second magnet 204 includes a north pole 220 and a south pole 222 opposite the north pole 220. The north pole 220 is defined by a side surface of the second magnet 204. The south pole 222 is defined by a side surface of the second magnet 204. The surface area of the side surfaces of the magnet 204 contribute to the arc suppression and controlling height, length, width of the side surface may affect arc suppression of the first magnet 204. Proximity of the first magnet 204 relative to the contacts 120, 122 may affect arc suppression. The second magnet 204 has a north B-field 224 (extending outward from the north pole 220). The second magnet 204 is oriented in the magnet slot 180 with the south pole 222 facing inward and the north pole 220 facing outward. The south pole 222 faces the contacts 120, 122. The north pole 220 faces the outer wall 111 of the housing 110. The north B-field 224 of the second magnet 204 faces outward toward the outer wall 111 of the housing 110, away from the contacts 120, 122. In an exemplary embodiment, the second magnet 204 is aligned with the second fixed contact 120*b*. The second magnet 204 is arranged at a first side 226 of the second fixed contact 120*b*.

The magnet assembly 164 includes a plurality of magnets integrated into a unitary magnet body 240. The unitary magnet body 240 includes the various magnets being held together as a single unit. The unitary magnet body 240 defines a monolithic structure wherein the magnets are coupled together as part of the unitary magnet body 240. Physical manipulation of any one of the magnets causes corresponding physical manipulation of the other magnet(s) of the magnet assembly 164. For example, transferring of the magnet assembly 164 into the magnet slot 180 or removing of the magnet assembly 164 from the magnet slot 180 allows transfer of all of the magnets of the magnet assembly 164 as a unitary structure. Individual magnets do not need to be physically transferred relative to each other.

In the illustrated embodiment, the magnet assembly 164 includes a first magnet 242, a second magnet 244, and a non-magnetic body 246 in the gap between the first and second magnets 242, 244. The non-magnetic body 246 is located between the first and second magnets 242, 244 and separates the first and second magnets 242, 244. The non-magnetic body 246 holds the relative positions of the first and second magnets 242, 244. The gap removes or reduces the magnetic field in an area of the magnet assembly 164 to reduce repulsive forces acting on the movable contact 122 that repulses the movable contact 122 away from the fixed contacts 120. The magnet assembly improves short circuit conditions, such as during high current conditions, by reducing the repulsive forces by reducing the magnetic fields of the magnet assembly 164, such as in areas offset from the areas generating the arc (for example, in the area offset from the fixed contacts 120). The gap may be located in the area between the fixed contacts 120.

In an exemplary embodiment, the magnets 242, 244 and the non-magnetic body 246 are extruded with each other to form the unitary magnet body 240. For example, the magnets 242, 244 may be neodymium magnets and the non-magnetic body 246 may be an aluminum block or other non-magnetic material block. The neodymium magnets may be co-extruded with the aluminum block to form the unitary magnet body 240. In other various embodiments, the magnets 242, 244 and the aluminum block may be separately manufactured and secured together, such as using adhesive, glue, welding, or other means. In other various embodiments, the magnets 242, 244 and the non-magnetic body 246 may be overmolded or wrapped, such as by a plastic outer body to form the unitary magnet body 240.

In an exemplary embodiment, the unitary magnet body 240 includes one or more keying features 248. In the illustrated embodiment, the keying feature 248 is a groove formed in a side of the non-magnetic body 246. Optionally, the keying feature 248 may be centered within the unitary magnet body 240. In other various embodiments, the keying feature 248 may be offset rather than being centered. In various embodiments, keying features 248 may be provided at multiple sides of the unitary magnet body 240. The keying features 248 may be located at other locations in alternative embodiments. In other various embodiments, the magnets 242, 244 may additionally or alternatively include the keying features 248. In other various embodiments, rather than being a groove, the keying feature 248 may be a rib or protrusion extending outward from one or more surfaces of the unitary magnet body 240. The keying feature 248 may be defined by other walls or surfaces of the unitary magnet body 240 in other various embodiments. For example, the top and/or the bottom and/or the sides may be angled or chamfered to define keying features.

In an exemplary embodiment, each of the magnets 242, 244 are arranged relative to the contacts 120, 122 such that the north B-fields of the magnets 242, 244 face outward, away from the contacts 120, 122. As such, the magnets 242, 244 force the arc debris outward away from the contacts 120, 122 quickly and efficiently.

The first magnet 242 includes a north pole 250 and a south pole 252 opposite the north pole 250. The north pole 250 is defined by a side surface of the first magnet 242. The south pole 252 is defined by a side surface of the first magnet 242. The surface area of the side surfaces of the magnet 242 contribute to the arc suppression and controlling height, length, width of the side surface may affect arc suppression of the first magnet 242. Proximity of the first magnet 242 relative to the contacts 120, 122 may affect arc suppression. The first magnet 242 has a north B-field 254 (extending outward from the north pole 250). The first magnet 242 is oriented in the magnet slot 180 with the south pole 252 facing inward and the north pole 250 facing outward. The south pole 252 faces the contacts 120, 122. The north pole 250 faces the outer wall 111 of the housing 110. The north B-field 254 of the first magnet 242 faces outward toward the outer wall 111 of the housing 110, away from the contacts 120, 122. In an exemplary embodiment, the first magnet 242 is aligned with the first fixed contact 120*a*. The first magnet 242 is arranged at a second side 256 of the first fixed contact 120*a*.

The second magnet 244 includes a north pole 260 and a south pole 262 opposite the north pole 260. The north pole 260 is defined by a side surface of the second magnet 244. The south pole 262 is defined by a side surface of the second magnet 244. The surface area of the side surfaces of the magnet 244 contribute to the arc suppression and controlling height, length, width of the side surface may affect arc suppression of the first magnet 244. Proximity of the first magnet 244 relative to the contacts 120, 122 may affect arc suppression. The second magnet 244 has a north B-field 264 (extending outward from the north pole 260). The second magnet 244 is oriented in the magnet slot 180 with the south pole 262 facing inward and the north pole 260 facing outward. The south pole 262 faces the contacts 120, 122. The north pole 260 faces the outer wall 111 of the housing 110. The north B-field 264 of the second magnet 244 faces outward toward the outer wall 111 of the housing 110, away from the contacts 120, 122. In an exemplary embodiment, the second magnet 244 is aligned with the second fixed contact 120*b*. The second magnet 244 is arranged at a second side 266 of the second fixed contact 120*b*.

In an exemplary embodiment, the magnet 202 of the magnet assembly 162 is arranged on the opposite side of the first fixed contact 120*a* and the movable contact 122 as the magnet 242 of the magnet assembly 164. The magnets 202, 242 are aligned with each other on the opposite sides 216, 256 of the first fixed contact 120*a*. The north B-field 214 of the magnet 202 faces in an opposite direction as the north B-field 254 of the magnet 242. In an exemplary embodiment, the north B-field 214 of the magnet 202 faces away from the magnet 242 and the north B-field 254 of the magnet 242 faces away from the magnet 202.

In an exemplary embodiment, the magnet 204 of the magnet assembly 162 is arranged on the opposite side of the second fixed contact 120*b* and the movable contact 122 as the magnet 244 of the magnet assembly 164. The magnets 204, 244 are aligned with each other on the opposite sides 226, 266 of the second fixed contact 120*b*. The north B-field 224 of the magnet 204 faces in an opposite direction as the north B-field 264 of the magnet 244. In an exemplary embodiment, the north B-field 224 of the magnet 204 faces away from the magnet 244 and the north B-field 264 of the magnet 244 faces away from the magnet 204.

Figure 5:
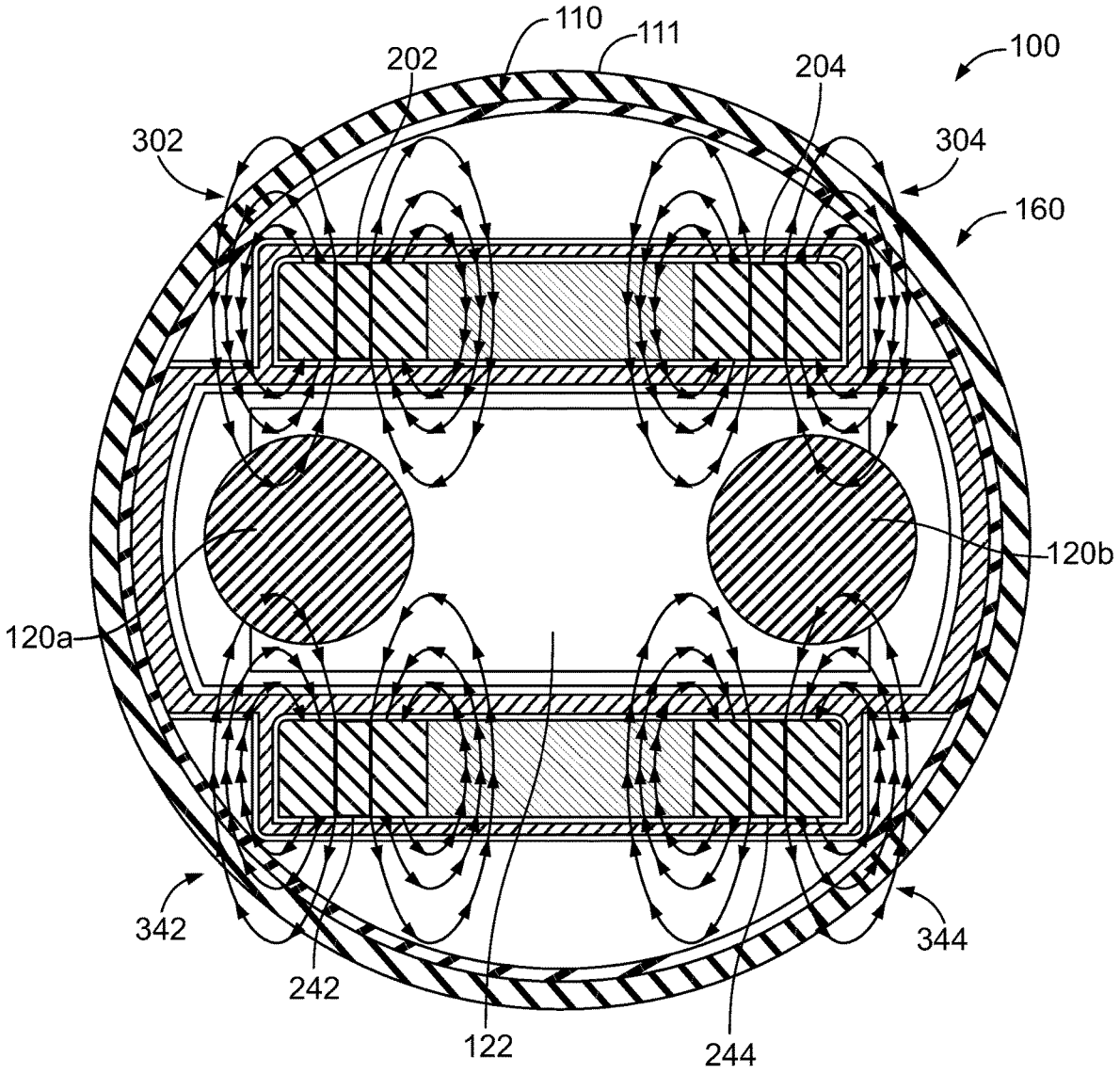
FIG. 5 is a cross sectional view of the contactor including the arc suppressor showing magnetic fields of magnets of the arc suppressor in accordance with an exemplary embodiment.

FIG. 5 is a cross sectional view of the contactor 100 including the arc suppressor 160 in accordance with an exemplary embodiment. FIG. 5 shows magnetic fields 302, 304, 342, 344 of the magnets 202, 204, 242, 244, respectively. The magnetic fields 302, 304, 342, 344 flow from north poles to south poles of the magnets 202, 204, 242, 244. The magnets 202, 204, 242, 244 are arranged with the north poles facing outward toward the outer wall 111 of the housing 110 away from the contacts 120, 122. In this configuration, the magnetic fields 302, 304, 342, 344 force the arc debris (not shown) outward away from the contacts 120, 122.

In an exemplary embodiment, the magnetic field 302 of the first magnet 202 directs arc debris away from the interface between the first fixed magnet 120*a* and the movable magnet 120 toward the outer wall 111. Similarly, the magnetic field 342 of the first magnet 242 directs arc debris away from the interface between the first fixed magnet 120*a* and the movable magnet 120 toward the outer wall 111. Similar, the magnetic field 304 of the second magnet 204 directs arc debris away from the interface between the second fixed magnet 120*b* and the movable magnet 120 toward the outer wall 111. Similar, the magnetic field 344 of the second magnet 244 directs arc debris away from the interface between the second fixed magnet 120*b* and the movable magnet 120 toward the outer wall 111.

Figure 6:
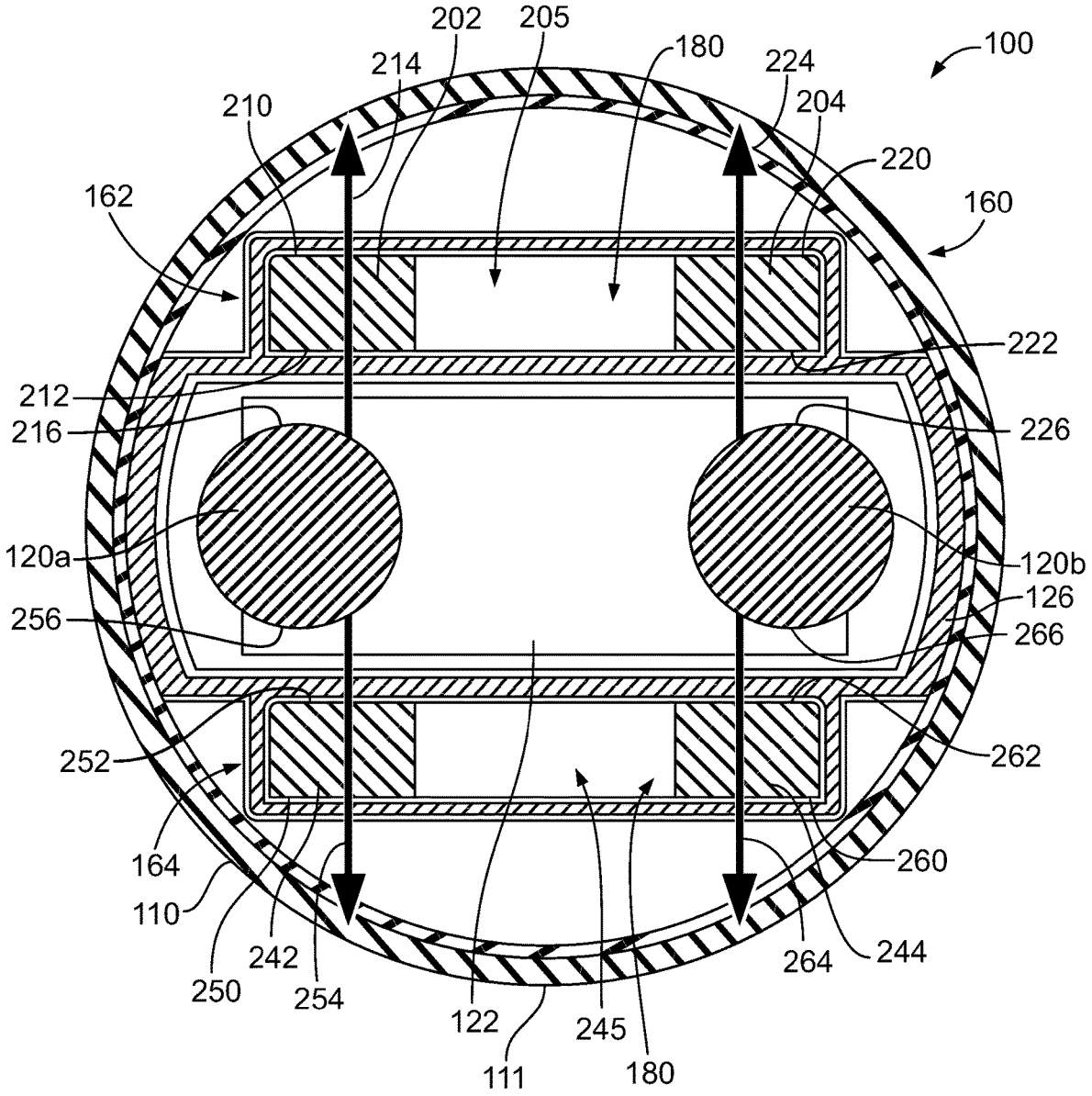
FIG. 6 is a cross sectional view of the contactor including the arc suppressor in accordance with an exemplary embodiment.

FIG. 6 is a cross sectional view of the contactor 100 including the arc suppressor 160 in accordance with an exemplary embodiment. FIG. 6 shows the magnet assemblies 162, 164 in the magnet slots 180 of the contact holder 126. In the illustrated embodiment, the magnet assembly 162 includes the first and second magnets 202, 204 without the non-magnetic body 206 (FIG. 4) therebetween. FIG. 6 illustrates a gap 205 between the first and second magnets 202, 204. The first and second magnets 202, 204 are separate and discrete from each other. The first and second magnets 202, 204 are separately loaded into the magnet slot 180 independent of each other and separated by the gap 205. In the illustrated embodiment, the magnet assembly 164 includes the first and second magnets 242, 244 without the non-magnetic body 246 (FIG. 4) therebetween. FIG. 6 illustrates a gap 245 between the first and second magnets 242, 244. The first and second magnets 242, 244 are separate and discrete from each other. The first and second magnets 242, 244 are separately loaded into the magnet slot 180 independent of each other and separated by the gap 245. The magnets 202, 204, 242, 244 may have keying features (not shown), such as grooves for orienting the magnets 202, 204, 242, 244 in the magnet slots 180.

The magnets 202, 204, 242, 244 are arranged relative to the contacts 120, 122 such that the north B-fields 214, 224, 254, 264 of the magnets 202, 204, 242, 244 face outward, away from the contacts 120, 122. As such, the magnets 202, 204, 242, 244 force the arc debris outward away from the contacts 120, 122 quickly and efficiently.

The first magnet 202 is oriented in the magnet slot 180 with the south pole 212 facing inward and the north pole 210 facing outward. The south pole 212 faces the contacts 120, 122. The north pole 210 faces the outer wall 111 of the housing 110. The north B-field 214 of the first magnet 202 faces outward toward the outer wall 111 of the housing 110, away from the contacts 120, 122.

The second magnet 204 is oriented in the magnet slot 180 with the south pole 222 facing inward and the north pole 220 facing outward. The south pole 222 faces the contacts 120, 122. The north pole 220 faces the outer wall 111 of the housing 110. The north B-field 224 of the second magnet 204 faces outward toward the outer wall 111 of the housing 110, away from the contacts 120, 122.

The first magnet 242 is oriented in the magnet slot 180 with the south pole 252 facing inward and the north pole 250 facing outward. The south pole 252 faces the contacts 120, 122. The north pole 250 faces the outer wall 111 of the housing 110. The north B-field 254 of the first magnet 242 faces outward toward the outer wall 111 of the housing 110, away from the contacts 120, 122.

The second magnet 244 is oriented in the magnet slot 180 with the south pole 262 facing inward and the north pole 260 facing outward. The south pole 262 faces the contacts 120, 122. The north pole 260 faces the outer wall 111 of the housing 110. The north B-field 264 of the second magnet 244 faces outward toward the outer wall 111 of the housing 110, away from the contacts 120, 122.

In an exemplary embodiment, the magnets 202, 242 are arranged on the opposite sides 216, 256 of the first fixed contact 120*a* and the movable contact 122 and the magnets 204, 244 are arranged on the opposite sides 226, 266 of the second fixed contact 120*b* and the movable contact 122. The north B-field 214 of the magnet 202 faces in an opposite direction as the north B-field 254 of the magnet 242. The north B-field 224 of the magnet 204 faces in an opposite direction as the north B-field 264 of the magnet 244. In an exemplary embodiment, the north B-field 214 of the magnet 202 faces away from the magnet 242 and the north B-field 254 of the magnet 242 faces away from the magnet 202. The north B-field 224 of the magnet 204 faces away from the magnet 244 and the north B-field 264 of the magnet 244 faces away from the magnet 204.

Figure 7:
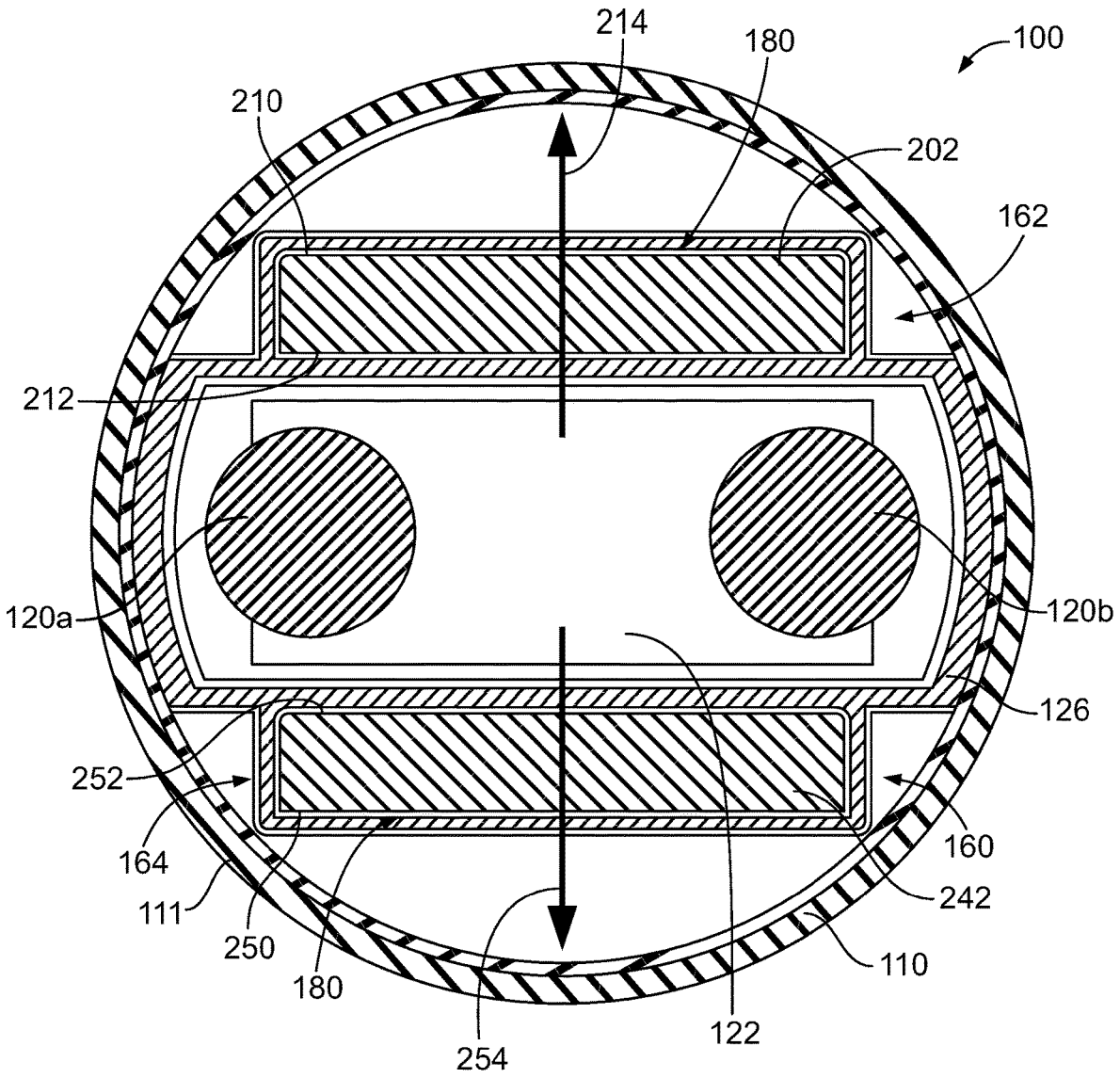
FIG. 7 is a cross sectional view of the contactor including the arc suppressor in accordance with an exemplary embodiment.

FIG. 7 is a cross sectional view of the contactor 100 including the arc suppressor 160 in accordance with an exemplary embodiment. FIG. 7 shows the magnet assemblies 162, 164 in the magnet slots 180 of the contact holder 126. In the illustrated embodiment, the magnet assembly 162 includes the first magnet 202 being elongated to span across the length of the magnetic slot 180 to span across both fixed contacts 120. The magnet assembly 162 does not include first and second magnets separated by a non-magnetic body or a gap as in the embodiments illustrated in FIGS. 4 and 6, respectively. In the illustrated embodiment, the magnet assembly 164 includes the first magnet 242 being elongated to span across the length of the magnetic slot 180 to span across both fixed contacts 120. The magnet assembly 164 does not include first and second magnets separated by a non-magnetic body or a gap as in the embodiments illustrated in FIGS. 4 and 6, respectively. The magnets 202, 242 may have keying features (not shown), such as grooves for orienting the magnets 202, 242 in the magnet slots 180. In other various embodiments, rather than both magnet assemblies being elongated, single magnets, the magnet assembly 162 may be elongated as shown and the magnet assembly 164 may include separate magnets 242, 244 as shown in FIG. 4 or 6 or the magnet assembly 164 may be elongated as shown and the magnet assembly 162 may include separate magnets 202, 204 as shown in FIG. 4 or 6.

The magnets 202, 242 are arranged relative to the contacts 120, 122 such that the north B-fields 214, 254 of the magnets 202, 242 face outward, away from the contacts 120, 122. As such, the magnets 202, 242 force the arc debris outward away from the contacts 120, 122 quickly and efficiently.

The magnet 202 is oriented in the magnet slot 180 with the south pole 212 facing inward and the north pole 210 facing outward. The south pole 212 faces the contacts 120, 122. The north pole 210 faces the outer wall 111 of the housing 110. The north B-field 214 of the magnet 202 faces outward toward the outer wall 111 of the housing 110, away from the contacts 120, 122.

The magnet 242 is oriented in the magnet slot 180 with the south pole 252 facing inward and the north pole 250 facing outward. The south pole 252 faces the contacts 120, 122. The north pole 250 faces the outer wall 111 of the housing 110. The north B-field 254 of the magnet 242 faces outward toward the outer wall 111 of the housing 110, away from the contacts 120, 122.

In an exemplary embodiment, the magnets 202, 242 are arranged on the opposite sides of the first fixed contact 120*a* and the second fixed contact 120*b*. The magnets 202, 242 are elongated to span across and be aligned with both the fixed contacts 120*a*, 120*b*. The north B-field 214 of the magnet 202 faces in an opposite direction as the north B-field 254 of the magnet 242. In an exemplary embodiment, the north B-field 214 of the magnet 202 faces away from the magnet 242 and the north B-field 254 of the magnet 242 faces away from the magnet 202.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A contactor comprising:

a housing having an outer wall defining a cavity;

fixed contacts received in the cavity, the fixed contacts having mating ends in the cavity;

a movable contact movable within the cavity between a mated position and an unmated position, the movable contact engaging the fixed contacts to electrically connect the fixed contacts in the mated position;

a coil assembly in the cavity operated to move the movable contact between the unmated position and the mating position; and an arc suppressor in the cavity, the arc suppressor including a first magnet located in the cavity on a first side of the movable contact and a second magnet located in the cavity on a second side of the movable contact, the first magnet being arranged in the cavity such that a north B-field of the first magnet faces outward toward the outer wall of the housing, the second magnet being arranged in the cavity such that a north B-field of the second magnet faces outward toward the outer wall of the housing.

2. The contactor of claim 1, wherein the north B-field of the first magnet faces in an opposite direction as the north B-field of the second magnet.

3. The contactor of claim 1, wherein the north B-field of the first magnet faces away from the second magnet and the north B-field of the second magnet faces away from the first magnet.

4. The contactor of claim 1, wherein the fixed contacts include a first fixed contact and a second fixed contact, the first magnet and the second magnet being aligned with the first fixed contact on opposite sides of the first fixed contact.

5. The contactor of claim 4, wherein the arc suppressor includes a third magnet located in the cavity on a first side of the second fixed contact and a fourth magnet located in the cavity on a second side of the second fixed contact, the third magnet being arranged in the cavity such that a north B-field of the third magnet faces outward toward the outer wall of the housing, the fourth magnet being arranged in the cavity such that a north B-field of the fourth magnet faces outward toward the outer wall of the housing.

6. The contactor of claim 5, wherein the north B-field of the third magnet faces in an opposite direction as the north B-field of the fourth magnet.

7. The contactor of claim 5, wherein a gap is provided between the first magnet and the third magnet and a gap is provided between the second magnet and the fourth magnet.

8. The contactor of claim 5, wherein a non-magnetic body is coupled to the first magnet and coupled to the third magnet and a non-magnetic body is coupled to the second magnet and coupled to the fourth magnet.

9. The contactor of claim 1, wherein the fixed contacts include a first fixed contact and a second fixed contact, the first magnet being aligned with the first fixed contact and the second fixed contact and the second magnet being aligned with the first fixed contact and the second fixed contact.

10. The contactor of claim 1, wherein the first magnet includes a keying feature for orienting the first magnet in the housing, the second magnet including a keying feature for orienting the second magnet in the housing.

11. A contactor comprising:

a housing having an outer wall defining a cavity;

a first fixed contact received in the cavity at a first end of the housing and a second fixed contact received in the cavity at a second end of the housing;

a movable contact movable within the cavity between a mated position and an unmated position, the movable contact engaging the first and second fixed contacts to electrically connect the first and second fixed contacts in the mated position;

a coil assembly in the cavity operated to move the movable contact between the unmated position and the mating position; and an arc suppressor in the cavity, the arc suppressor including a first magnet located in the cavity on a first side of the first fixed contact, a second magnet located in the cavity on a second side of the first fixed contact, a third magnet located in the cavity on a first side of the second fixed contact and a fourth magnet located in the cavity on a second side of the second fixed contact, the first magnet being arranged in the cavity such that a north B-field of the first magnet faces outward toward the outer wall of the housing, the second magnet being arranged in the cavity such that a north B-field of the second magnet faces outward toward the outer wall of the housing, the third magnet being arranged in the cavity such that a north B-field of the third magnet faces outward toward the outer wall of the housing, the fourth magnet being arranged in the cavity such that a north B-field of the fourth magnet faces outward toward the outer wall of the housing.

12. The contactor of claim 11, wherein the north B-field of the first magnet faces in an opposite direction as the north B-field of the second magnet and the north B-field of the third magnet faces in an opposite direction as the north B-field of the fourth magnet.

13. The contactor of claim 11, wherein the north B-field of the first magnet faces away from the second magnet and the north B-field of the second magnet faces away from the first magnet, and wherein the north B-field of the third magnet faces away from the fourth magnet and the north B-field of the fourth magnet faces away from the third magnet.

14. The contactor of claim 11, wherein a gap is provided between the first magnet and the third magnet and a gap is provided between the second magnet and the fourth magnet.

15. The contactor of claim 11, wherein a non-magnetic body is coupled to the first magnet and coupled to the third magnet and a non-magnetic body is coupled to the second magnet and coupled to the fourth magnet.

16. A contactor comprising:

a housing having an outer wall defining a cavity;

fixed contacts received in the cavity, the fixed contacts having mating ends in the cavity;

a movable contact movable within the cavity between a mated position and an unmated position, the movable contact engaging the fixed contacts to electrically connect the fixed contacts in the mated position;

a coil assembly in the cavity operated to move the movable contact between the unmated position and the mating position; and an arc suppressor in the cavity, the arc suppressor including a first magnet located in the cavity on a first side of the movable contact and a second magnet located in the cavity on a second side of the movable contact, the first magnet including a north pole and a south pole, the second magnet including a north pole and a south pole, the first magnet being arranged in the cavity such that the north pole of the first magnet faces outward toward the outer wall of the housing and the south pole of the first magnet faces the movable contact, the second magnet being arranged in the cavity such that the north pole of the second magnet faces outward toward the outer wall of the housing and the south pole of the first magnet faces the movable contact.

17. The contactor of claim 16, wherein the south pole of the first magnet faces the south pole of the second magnet.

18. The contactor of claim 16, wherein the arc suppressor includes a third magnet located in the cavity on the first side of the movable contact and a fourth magnet located in the cavity on the second side of the movable contact, the third magnet including a north pole and a south pole, the fourth magnet including a north pole and a south pole, the third magnet being arranged in the cavity such that the north pole of the third magnet faces outward toward the outer wall of the housing and the south pole of the third magnet faces the movable magnet, the fourth magnet being arranged in the cavity such that a north pole of the fourth magnet faces outward toward the outer wall of the housing and the south pole of the fourth magnet faces the movable contact.

19. The contactor of claim 18, wherein the fixed contacts include a first fixed contact and a second fixed contact, the first magnet and the second magnet being aligned with the first fixed contact on opposite sides of the first fixed contact, the third magnet and the fourth magnet being aligned with the second fixed contact on opposite sides of the second fixed contact.

20. The contactor of claim 16, wherein the fixed contacts include a first fixed contact and a second fixed contact, the first magnet being aligned with the first fixed contact and the second fixed contact and the second magnet being aligned with the first fixed contact and the second fixed contact.

* * * * *